US005346213A

United States Patent [19]

Yamada

[11] Patent Number: 5,346,213

[45] Date of Patent: Sep. 13, 1994

[54] GOLF CLUB HEAD

[75] Inventor: Magoichi Yamada, Tokyo, Japan

[73] Assignee: Daiwa Golf Co., Ltd., Tokyo, Japan

[21] Appl. No.: 8,494

[22] Filed: Jan. 25, 1993

[30] Foreign Application Priority Data

Jan. 23, 1992 [JP] Japan ..... 4-001954[U]

[51] Int. Cl.[5] ..... A63B 53/04

[52] U.S. Cl. ..... 273/78; 273/173

[58] Field of Search ..... 273/78, 173, 174

[56] References Cited

U.S. PATENT DOCUMENTS

| | | | |
|---|---|---|---|
| 564,655 | 7/1896 | Slade | 273/78 |
| 4,121,832 | 10/1978 | Ebbing | 273/171 |
| 4,653,756 | 3/1987 | Sato | 273/167 E |
| 4,798,383 | 1/1989 | Nagasaki et al. | 273/167 H |

FOREIGN PATENT DOCUMENTS

| | | |
|---|---|---|
| 57-182470 | 11/1982 | Japan . |
| 59-82062 | 6/1984 | Japan . |
| 59-82063 | 6/1984 | Japan . |
| 59-164665 | 11/1984 | Japan . |
| 59-193452 | 12/1984 | Japan . |
| 60-49868 | 4/1985 | Japan . |
| 62-155557 | 10/1985 | Japan . |
| 62-113570 | 7/1987 | Japan . |
| 63-68371 | 5/1988 | Japan . |
| 3-7178 | 1/1991 | Japan . |

*Primary Examiner*—George J. Marlo
*Attorney, Agent, or Firm*—Longacre & White

[57] ABSTRACT

A golf club head includes a metal head body and a face plate made of fiber reinforced resin and fitted to a recess formed in a face portion of the metal head body. A support pin is inserted into the main body from a back portion thereof, threadingly engaged with the face plate and prevented from being exposed on a hitting surface of the face plate. A back portion of the head body is formed with a concave whose outer configuration is substantially the same as that of the face plate. The concave is located at a position of the back portion corresponding to a position of the face plate on the face portion. A central recess is further formed in the back portion within the concave depending on a position of a sweet spot. A flexible member is attached to the central recess. It is possible to reliably prevent the accidental separation of the face plate from the head body, and the damage and/or breakage of the face plate due to the difference in stiffness between the face plate and the metal head body.

19 Claims, 4 Drawing Sheets

GOLF CLUB HEAD

BACKGROUND OF THE INVENTION a) Field of the Invention

The present invention relates to a metal golf club head to which a face plate of different material is attached, and, in particular, to an improvement by which a face plate is securely fixed to a golf club head and the attached face plate is prevented from being damaged due to the impact when a golf ball is hit.

b) Description of the Prior Art

Generally, an iron golf club head is formed of a metal such as soft iron and stainless with an integral hosel portion, an integral sole portion and an integral face portion.

The golf club head of this kind has the configuration and weight corresponding to each club number, suffers from a problem that the head is poor in elastic property because the mass of metal, and, in particular, a face portion of the golf club head, which portion is the most important in hitting a ball, is also poor in elastic property. The golf club head of this type is, therefore, poor in repellent property and a soft hit feeling as obtained by a wooden golf club head can not be obtained.

In order to obtain the soft feeling in hitting a golf ball, there has been proposed a golf club head made of metal, to which a face plate made of a fiber-reinforced resin is attached at the face portion, as disclosed, for instance, in the Japanese Utility Model Unexamined Publication Nos. Sho. 62-113570 and 63-68371.

A golf club head disclosed in the Publication No. Sho. 62-113570 is shown in FIG. 7. The golf club head has a notched portion 5 formed in a face portion 3 of a metal head body 1. A face plate 11 made up of a metal base 7 and a fiber-reinforced resin layer 9 integrally secured to the metal base 7, is fitted to the notched portion 5 and secured thereto by fixing the head body 1 to the metal base 13 by a screw 13.

FIG. 8 shows another conventional golf club head disclosed in Publication No. Sho. 63-68371, which has a head body 15 made of metallic material, a recess portion 19 formed in an opposite side of the head body corresponding to a face portion 17, and an elastic member 21 made of fiber-reinforce material. The elastic material 21 is mounted onto a bottom 19*a* of the recess portion 19, to thereby form a complex-hitting surface portion 23 on the head body 15.

Generally, a disadvantage has been pointed out in the golf club head of this kind such that if a shock or impact caused when a golf ball is hit has been repeated for a long time period of use, then a face plate is damaged and/or broken due to difference in stiffness between the metal head body and the fiber-reinforced-resin-made face plate. Even the golf club head shown in FIG. 7 suffers from the same problem that the face plate 11 is likely to be damaged and/or broken upon the impact of hitting due to the difference in stiffness between the head body 1 or the metal base 7 and the fiber-reinforced resin layer 9.

In the golf club head shown in FIG. 8, the two-layer construction made up of metal and elastic material is formed by mounting the elastic member 21 onto the reverse side of the head body 15 so as to prevent the elastic member from being damaged. Not only it is difficult to obtain a soft hit feeling in comparison with a golf club head in which the face plate is mounted onto a surface of the face portion, but also the elastic member 21 is likely to be damaged and broken due to the difference in stiffness between the metal head body 15 and the elastic member 21 upon shock of the hitting.

Further, since the different materials, i.e. the metal and fiber-reinforced resin are adhered together by adhesive, the resin member is likely to be peeled off from the metal men, bet upon a shock of hitting repeatingly experienced for a long time use.

SUMMARY OF THE INVENTION

The present invention was made in order to solve the above-mentioned problems occurring in the prior art.

Accordingly, it is an object of the present invention to provide a golf club head in which a face plate and a head body different in material from each other are securely fixed together to reliably prevent the accidental separation of the face plate from the head body.

Another object of the present invention is to provide a golf club head in which a face plate attached to a head body is permitted to be elastically deformed when a golf ball is hit, thereby preventing the damage and/or breakage of the face plate due to the difference in stiffness between the face plate and the metal head body.

In order to attain the above-noted and other objects, the present invention provides a golf club head which includes a metal main body including integral face, back and sole portions, a face plate made of synthetic resin and attached to the face portion for defining a hitting surface and a support pin inserted into the main body from the back portion, threadingly engaged with the face plate and prevented from being exposed on the hitting surface.

The present invention further provides a golf club head which includes a metal main body including integral face, back and sole portions and a face plate made of synthetic resin and attached to the face portion, and in which the back portion is formed with a concave whose outer configuration is substantially the same as that of the face plate, the concave being located at a position of the back portion corresponding to a position of the face plate on the face portion.

DETAILED DESCRIPTION OF THE PREFERRED EMBODIMENTS

Preferred embodiments of the present invention will now be described in detail with reference to the drawings attached hereto.

Figure 1:
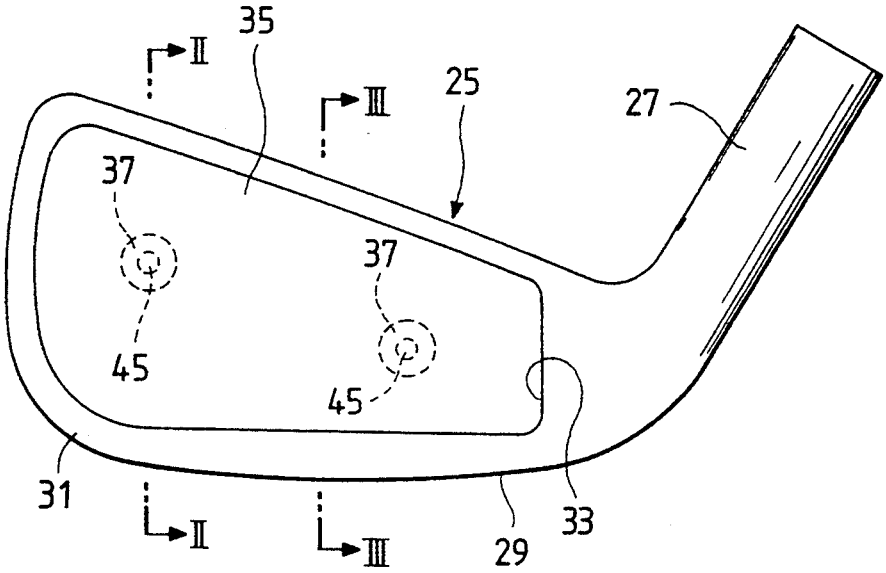
FIG. 1 is a front view showing a golf club head according to a first embodiment of the present invention.

FIGS. 1 to 5 show a golf club head according to an embodiment of the present invention. In FIG. 1, reference numeral 25 designates a head body made of metal such as soft iron and stainless steel. The head body 25 includes an integral hosel portion 27, an integral sole portion 29, and an integral face portion 31. As show in FIGS. 2 and 3, the face portion 31 is formed with a recessed fitting portion 33 around which a peripheral portion 31*a* remains. A face plate 35 is fitted and adhered to the fitting portion 33.

The face plate 35 is made preferably of high-elastic fiber-reinforced resin reinforced by carbon or glass fibers so as to be increased in strength and improved in the repellent property. The face plate 35 is formed such that the shape of the outer periphery of the face plate 35 is conformed with that of the inner periphery of the fitting portion 33, and has a predetermined thickness so as to define a flush surface together with the face portion 31 when the face plate 35 is fitted and adhered to the fitting portion 33.

Since the face plate 35 is fitted into the recessed fitting portion formed in the face portion 31 of the head body 25, it is possible to prevent a peripheral edge of the face plate 35 from being damaged, easily mount the face plate 35 on the head body 25 in place and fixedly secure the face plate 35 onto the head body 25 to prevent the accidental separation of the face plate 35 from the head body 25 due to the impact when a ball is hit.

Column-like protrusions 37 are provided on heel and toe sides of the face plate 31, respectively. Fitting holes 39 for receiving the respective protrusions 37 therein are provided in the bottom portion 33*a* of the fitting portion 33.

Figure 3:
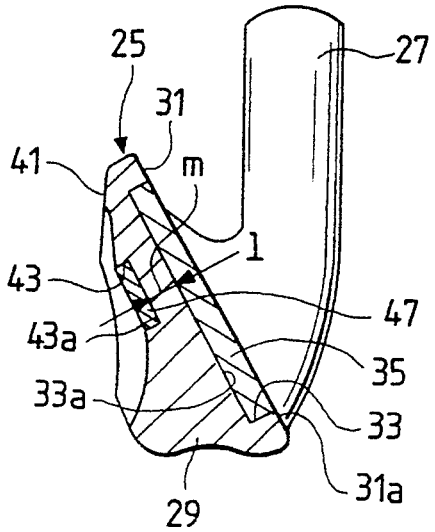
FIG. 3 is a cross-sectional view taken along line III—III of FIG. 1.

Generally, an iron golf club head is formed with the so-called "cavity-back" such that a concave is formed in a back portion of the golf club head except for a peripheral portion thereof. Similarly to this cavity-back arrangement, the golf club head 25 according to the embodiment of the present invention has a back portion 41 formed with a concave at a portion opposite and corresponding to the face portion 31, especially to the fitting portion 33, as shown in FIG. 3. Further, in addition to the above-noted cavity-back arrangement, a central concave or recess 43 is further formed at a central portion of the back portion 41 within the former concave.

Figure 4:
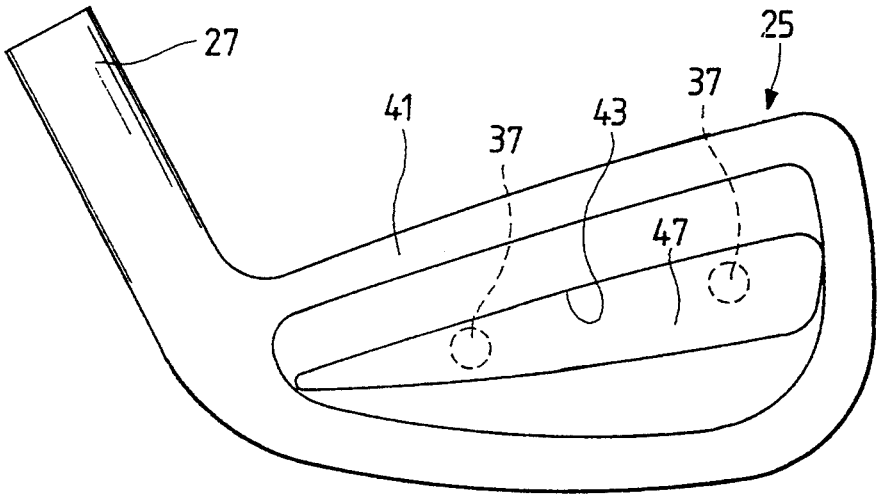
FIG. 4 is a rear view showing the golf club head shown in FIG. 1.
Figure 5:
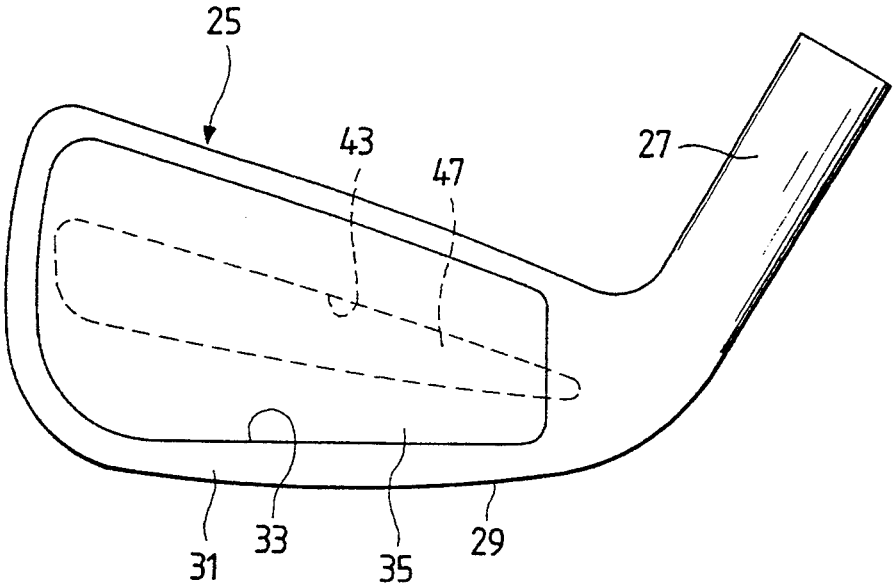
FIG. 5 is a front view showing the golf club head shown in FIG. 1, in which a central recess is depicted.

As best shown in FIGS. 4 and 5, the central recess 43 extends from a heel side to a toe side of the head body 25 with its width gradually increased depending on the outer shape of the face portion 31. The central recess 43 is located so that an imaginary line l which passes through a gravity center of the golf club head and is perpendicular to the hitting surface of the golf club, passes through the central recess 43. In other word, the so-called "sweet spot" is located on the face plate 31 corresponding to a portion where the central recess 43 is formed, the intersecting point between the imaginary/line 1 and the hitting surface of the golf club being defined as the "sweet spot". The central recess 43 is also formed for the purpose of the reduction of the thickness of the head body 25 between the back portion 4 and the face portion 31. The reduced thickness m between the bottom portions 33*a* and 43*a* of the fitting portion 33 and the recess 43 contributes to reduce the stiffness of the head body 25 at that portion, thereby reducing the stiffness difference between the head body 25 and the face plate 35, in comparison with the conventional arrangements.

Figure 2:
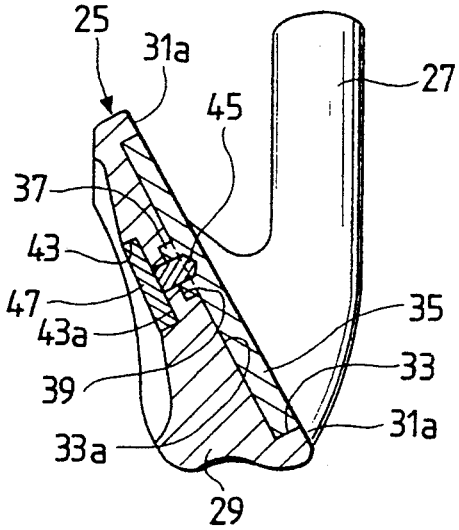
FIG. 2 is a cross-sectional view taken along line II—II of FIG. 1.

As shown in FIG. 2, a support pin or screw 45 is threadingly engaged with each of the protrusions 37 from the central recess 43 side so as to fixedly secure the face plate 35 to the fitting portion 33. Since the support pin 45 is prevented from being exposed from a ball hitting surface of the face plate 35 so that the ball hitting surface is defined by one material, it is possible to enhance the directionability of the golf ball and prevent the damage of the face plate 35 around the support pin 45 due to the impact. The support pin 45 is directed perpendicular to the face plate 35 to bear against the stress of the impact when ball is hit, so that it is possible to prevent the support pin 45 from being loosened and the threadingly engaging portion between the support pin 45 and the face plate 35 from being broken. The support pin 45 threadingly engaged with the face plate 35 is not located at a position immediately behind the sweet spot and is located at a heel or toe side, so that the stress of the impact is prevented from being directly transmitted to the threadingly engaging portion between the support pin the face plate. The support pin 45 is threadingly engaged with the face plate 35 sufficiently due to provision of the protrusions 37 which increase the thickness of a portion of the face plate 35.

A soft or flexible member 47 having an elastic coefficient lower than that of the face plate 35 and also having the viscoelasticity or rubber-like elastic characteristic, is sealingly adhered to the central recess 43, and made, for instance, of synthetic resin, rubber or the like. The flexible member 47 functions to permit the thickness-reduced portion of the head main body 25 corresponding to the sweet spot to be elastically deformed and to receive the impact energy caused on the head main body 25 when a golf ball is hit.

More specifically, when a ball is hit with a golf club employing the golf club head 25 according to the embodiment of the present invention, most of the impact energy causing on the hitting point of the golf club head 25, is transmitted from the face 31 to the back portion 41 in a direction perpendicular to the face 31. Due to the arrangement of the present invention the thickness-reduced portion behind the sweet spot is permitted to be elastically deformed or deflected and the flexible men%her 47 mounted to the recess 43 supports such elastic deformation. Thus, the impact energy is efficiently converted into the repellent force without the face plate 35 being damaged, and further a player can get a soft ball hit feeling. The flexible men, bet 47 also serves to cover a head portion of the support pin 45, to prevent the support pin 45 from being loosened and to improve the aesthetic appearance of the golf club head.

Further, in the embodiment described above, since the central recess 43 to which the flexible member 47 is mounted, is formed in the head body 25 from the heel side to the toe side, the same effect can be obtained even if the face plate 35 strikes the golf ball at points offset from the best point or sweet spot.

Therefore, according to the embodiment of the present invention, a player can obtain the soft ball hitting feeling owing to the provision of the sole plate 35 attached to the face portion 31 as similarly to the conventional art arrangement. Further, since the recess 43 is rosined in an appropriate portion of the back portion 41 behind the sweet spot, the thickness of the head body in that portion is reduced in comparison with the other remaining portion, resulting in the reduction of the difference in stiffness between the head main body 25 and the face plate 35 at that portion. This construction in cooperation with the soft member 47 mounted to the recess 43, absorbs the impact energy caused on the head body 25 and allows the deflection of the thickness reduced portion behind the sweet spot. Accordingly, the load onto the face plate 35 due to the striking stress can be reduced in comparison with the conventional art arrangement, whereby the damage and breakage of the face plate 35 can be surely prevented.

Figure 6:
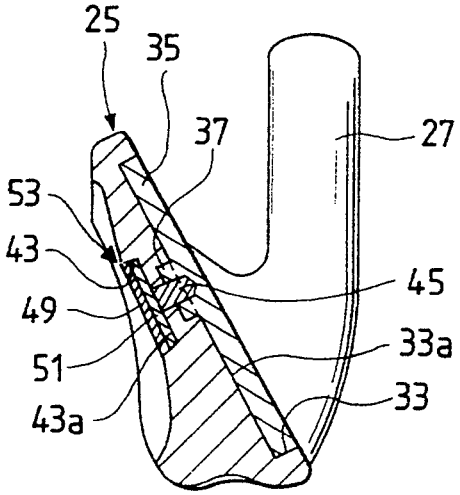
FIG. 6 is a cross-sectional view showing a golf club head according to a second embodiment of the present invention and corresponding to the FIG. 2 for the first embodiment.
Figure 7:
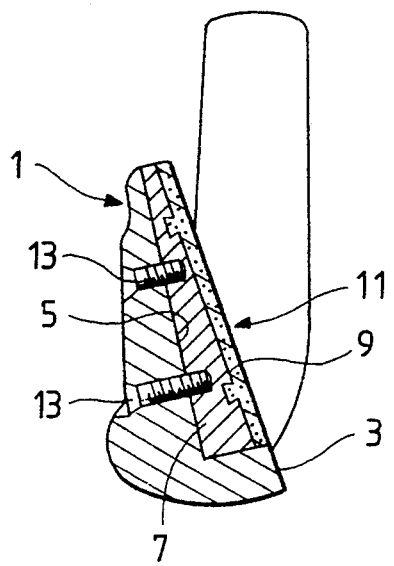
FIG. 7 PRIOR ART
FIG. 7 is a cross-sectional view showing a conventional golf club head.
Figure 8:
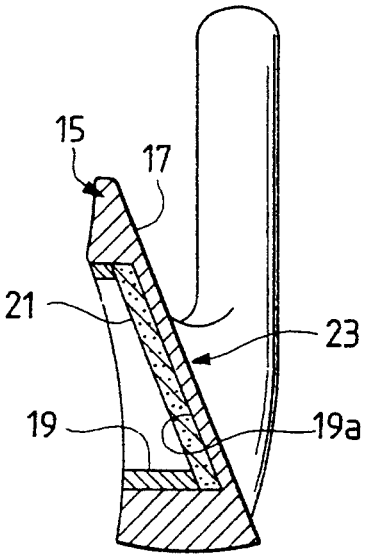
FIG. 8 PRIOR ART
FIG. 8 is a cross-sectional view showing another conventional golf club head.

FIG. 6 shows a second embodiment of the present invention. In this embodiment, a flexible member 53 made up of a synthetic resin plate 49 to which an urethane group resin 51 is applied, is mounted and adhered to the recess 43, in place of the flexible member 47 of the first embodiment. The other arrangement of the second embodiment is the same as that of the first embodiment, so that the same or functionally corresponding part is denoted by the same reference numeral with the detailed description being omitted here.

According to the second embodiment, it is possible to achieve the stated objects as similarly to the first embodiment, and further the second embodiment has an advantage in that the flexible material can be mounted to the recess 43 easily in comparison with the first embodiment.

As noted above, according to a first aspect of the present invention, since a face plate made of synthetic resin is attached to a head body made of metal using a support pin or screw, it is possible to securely fix the face plate to the head body and to reliably prevent the accidental separation of the face plate from the head body.

According to a second aspect of the present invention, since a face plate made of synthetic resin is attached to a golf club head body made of metal and further a concave or cavity is formed in a back portion of the head body, it is possible to reduce the skill level required for critical golf shots. Further, the concave is located at a position in the back portion corresponding to the face plate and has substantially the same outline as the face plate, so as to permit the face plate to be elastically deformed entirely when a golf ball is hit. Thus, the repellent force of the entire face plate can be effectively and efficiently utilized, thereby increasing the flying distance of the ball. Since a central recess is formed in the back portion of the head body with the concave and filled with a flexible member, it is possible to reduce the difference in stiffness between the metal head body and the face plate, thereby reducing the load of impact on the face plate. Further, since the face plate is enclosed with a peripheral portion of a face portion of the head body, an energy of the elastic deformation due to the impact when the ball is hit is efficiently and effectively converted into the repellent energy. In addition, the configuration of the face plate is substantially the same as that of the face portion of the golf club head so that a ball hitting surface and sweet spot are increased in area.

The present invention is not confined to the embodiments described above, but may be embodied or practiced in other various wars without departing the spirits or essential of the invention.

What is claimed is:

1. A golf club head comprising:

an iron main body including integral face, back and sole portions;

a face plate made of synthetic resin and attached to said face portion for defining a hitting surface;

a support pin inserted into said main body from said back portion, threadingly engaged with said face plate and prevented from being exposed on said hitting surface; and cover means provided on said back of said support pin wherein said cover means is formed of a flexible member.

2. The golf club head according to claim 1, wherein said support pin is directed substantially perpendicular to said face plate.

3. The golf club head according to claim 1, wherein said support pin is threadingly engaged with said face plate at a position where a sweet spot is not defined.

4. The golf club head according to claim 3, wherein said support pin is threadingly engaged with a toe side portion of said face plate.

5. The golf club head according to claim 3, wherein said support pin is threadingly engaged with a heel side portion of said face plate.

6. The golf club head according to claim 1, wherein said face plate is formed with a protrusion to which said support pin is threadingly engaged.

7. The golf club head according to claim 1, wherein said face plate is made of fiber reinforced resin.

8. A golf club head comprising:

an iron main body including integral face, back and sole portions;

a face plate made of synthetic resin and attached to said face portion, said face plate defining a first outer configuration around its perimeter, wherein said back portion is formed with a concave area defining a second outer configuration around its perimeter, said concave area being located at a position of said back portion opposite a position of said face plate on said face portion, and wherein said first outer configuration is substantially the same as said second outer configuration.

9. The golf club head according to claim 8, wherein said face portion is formed with a recess to which said face plate is fitted.

10. The golf club head according to claim 9, wherein said face plate has a predetermined thickness for defining a flush surface together with said face portion.

11. The golf club head according to claim 9, wherein an entire outer periphery of said face plate is circumscribed by said face portion.

12. The golf club head according to claim 8, wherein a central recess is formed in said back portion within said concave area.

13. The golf club head according to claim 12, further comprising:

a flexible member attached to said central recess.

14. The golf club head according to claim 12, wherein said recess defines a thickness-reduced portion adjacent said face plate arranged to be elastically deformed when a hitting force is applied to said main body.

15. The golf club head according to claim 14, wherein a flexible member is inserted in said central recess.

16. The golf club head according to claim 8, wherein said face plate is made of fiber reinforced resin.

17. A golf club head comprising:

an iron main body including integral face, back and sole portions;

a face plate made of synthetic resin and attached to said face portion for defining a hitting surface; and a support pin inserted into said main body from said back portion, threadingly engaged with said face plate and prevented from being exposed on said hitting surface, wherein said main body is formed with a recess substantially extending from a heel portion proximate a hosel to a toe portion distal said heel portion.

18. The golf club head according to claim 17, wherein said recess defines a thickness-reduced portion adjacent said face plate arranged to be elastically deformed when a hitting force is applied to said main body.

19. The golf club head according to claim 17, wherein a flexible member is inserted in said central recess.

* * * * *